US008174457B1

(12) United States Patent
Lam

(10) Patent No.: US 8,174,457 B1
(45) Date of Patent: May 8, 2012

(54) BROADBAND TELEVISION ANTENNA

(75) Inventor: Alan M. L. Lam, Hong Kong (HK)

(73) Assignee: RadioShack, Corporation, Fort Worth, TX (US)

( * ) Notice: Subject to any disclaimer, the term of this patent is extended or adjusted under 35 U.S.C. 154(b) by 668 days.

(21) Appl. No.: 12/358,316

(22) Filed: Jan. 23, 2009

(51) Int. Cl.
*H01Q 9/38* (2006.01)

(52) U.S. Cl. ..... 343/828; 343/829; 343/846

(58) Field of Classification Search ..... 343/702, 343/720, 825, 826, 828–830, 845, 846, 847
See application file for complete search history.

(56) References Cited

U.S. PATENT DOCUMENTS

| | | | | |
|---|---|---|---|---|
| 2,821,710 | A | 1/1958 | Hale | |
| 3,261,019 | A | 7/1966 | Lundy | |
| 3,587,105 | A * | 6/1971 | Neilson | 343/710 |
| 4,293,861 | A * | 10/1981 | Winegard et al. | 343/766 |
| 6,856,287 | B2 | 2/2005 | Rao et al. | |
| 7,319,432 | B2 * | 1/2008 | Andersson | 343/702 |
| 7,330,153 | B2 | 2/2008 | Rentz | |
| 7,535,431 | B2 * | 5/2009 | Rowell | 343/846 |
| 2001/0050636 | A1 | 12/2001 | Weinberger | |

* cited by examiner

*Primary Examiner* — Michael C Wimer
(74) *Attorney, Agent, or Firm* — Dan Brown Law Office; Daniel R. Brown

(57) ABSTRACT

A broadband antenna apparatus that is generally disposed along a plane. The antenna apparatus includes a ground plate with an edge and an inverted "L" antenna that has a base leg and an elongated leg, which define an interior corner. The interior corner is filled with a triangulated portion for broadening the bandwidth of the antenna. There is an antenna feed point at a distal end of the base leg. The antenna is oriented so that the distal end of the base leg is adjacent to the edge, forming a first dielectric gap therebetween, and further oriented with the elongated leg parallel to the edge. A first parasitic ground element extends from the edge and is positioned adjacent to the base leg, forming a second dielectric gap therebetween. The antenna apparatus also includes a second parasitic ground element extending from the edge of the ground plate.

28 Claims, 12 Drawing Sheets

BROADBAND TELEVISION ANTENNA

BACKGROUND OF THE INVENTION

1. Field of the Invention

The present invention relates to radio frequency antennas. More particularly, the present invention relates to a compact broadband high definition television antenna.

2. Description of the Related Art

Prior art television antennas fall into two broad categories, the indoor antenna and the outdoor antenna. The indoor antennas are sometimes referred to as set-top antenna, and the outdoor antenna are commonly mounted to a mast located above the rooftop of a home or other building. Since US television broadcasts have occurred on both the VHF band (54 MHz to 216 MHz) and the UHF band (470 MHz to 890 MHz), prior art antenna structures have been design to receive in both of these bands. In fact, most prior art antenna systems have included two antenna structures, one for each band. For example, a common prior art indoor antenna includes a 7.5" loop antenna for the UHF band and a pair of telescopic dipole elements for the VHF band. Similarly, prior art outdoor antenna have included a large vagi or log-periodic array for the VHF band, and various smaller structures for the UHF band, such as a small array, loops, bowtie structures, and others.

Where there are two separate antenna operating at different frequency bands, there is a need to combine these signals, so as to avoid the need for running two separate feed lines to the television receiver. Such combination has been achieved using filters, baluns, duplexers, diplexers, and other combining circuit designs. A combining circuit will always introduce some attenuation to the received signals. This attenuation may be overcome, to some extent, using a radio frequency (RF) amplifier located adjacent to the antenna. Since there are typically two distinct frequency bands, two separate radio frequency amplifiers are required. As the system is made more complex, it becomes more expensive. As the antenna structure is made larger to enhance RF performance, it becomes more expensive, more difficult to install, and less attractive to consumers.

The original US television standard was promulgated as the NTSC standard (National Television System Committee) in 1941, and is well known to those skilled in the art. The United States has promulgated a new standard, called the ATSC (Advanced Television Systems Committee), which is a digital broadcast format, commonly referred to as HDTV (High Definition Television). The ATSC standard is fully implemented on Feb. 17, 2009. Additionally, over the decades, the frequency bands have becomes more narrowly defined. For example, the higher UHF channels from 69-83 were reallocated in the 1980s to land mobile radio, which narrowed the UHF TV band to 470 MHz to 800 MHz. On the Feb. 19, 2009 date, UHF channels 52-69 will also be reallocated, again narrowing the band to 470 MHz to 698 MHz. In a similar vein, the VHF band is also being more narrowly used. The VHF band actually consists of two separate frequency bands, VHF-Low channels 2-6 (54 MHz to 88 MHz) and VHF-H channels 7-13 (174 MHz to 216 MHz). As the nation transitions to the ATSC standard, there will be very few remaining VHF-L broadcast broadcast stations, which implies that coverage of the VHF-L band is not required in many markets. Thus, it can be appreciated that there is a need in the art form an improved TV antenna apparatus adapted to the new ATSC standard, the more narrowly defined frequency bands, and the market demands for low cost, compact size, high RF performance, and simplicity in installation.

SUMMARY OF THE INVENTION

The need in the art is addressed by the apparatus of the present invention. The present invention teaches a broadband antenna apparatus that is generally disposed along a plane. The antenna apparatus includes a ground plate with an edge and an inverted "L" antenna that has a base leg and an elongated leg, which define an interior corner. The interior corner is filled with a triangulated portion for broadening the bandwidth of the antenna. There is an antenna feed point at a distal end of the base leg. The antenna is oriented so that the distal end of the base leg is adjacent to the edge, forming a first dielectric gap therebetween, and further oriented with the elongated leg parallel to the edge. A first parasitic ground element extends from the edge and is positioned adjacent to the base leg, forming a second dielectric gap therebetween. The antenna apparatus also includes a second parasitic ground element extending from the edge of the ground plate.

In a specific embodiment of the foregoing antenna apparatus, the first parasitic ground element is configured to yield an input impedance to the feed point that is optimized to match the impedance of a feed line. In a refinement to this embodiment, the second parasitic element is configured to further broaden the bandwidth of the antenna element without significantly degrading the optimized match to the feed line impedance. In another specific embodiment, the first parasitic ground element extends perpendicularly from the edge of the ground plate, and in parallel with the base leg of the antenna element. In another specific embodiment, the second parasitic ground element extends perpendicularly from the edge of the ground plate.

In a specific embodiment of the foregoing antenna apparatus, the ground plate, the antenna element, the first parasitic ground element, and the second parasitic ground element are fabricated as conductive etchings on a printed circuit board substrate. In another specific embodiment, the antenna base leg and elongated leg both have a width that is between three and nine percent of their combined length. In a refinement to this embodiment, the first parasitic ground element has a width that is substantially the same as the width of the antenna elongated leg. In another specific embodiment of the antenna apparatus, the antenna is proportioned to yield a center frequency within the UHF television band between 470 MHz and 900 MHz.

The present invention also teaches a broadband antenna apparatus that is generally disposed along a plane, which has a ground plate with a linear edge disposed along the plane, and an antenna element disposed along the plane, with a base leg at right angle to an elongated leg. The legs define an exterior "L" shape and an interior corner. The interior corner is filled with a triangulated portion through substantially the entire length of the base leg and through a portion greater than fifty percent of the length of the elongated leg, which serves to broaden the bandwidth of the antenna element. The antenna element has a radio frequency feed point located adjacent to the distal end of its base leg. The ground plate and the antenna element are oriented such that the distal end of the base leg is positioned adjacent to the linear edge, forming a first dielectric gap therebetween, and also oriented with the elongated leg of the antenna element arranged substantially in parallel to the edge. A first parasitic ground element extends perpendicularly from the linear edge of the ground plate, and is adjacent to and substantially in parallel with the exterior side of the base leg of the antenna element, which defines a second dielectric gap therebetween. The first parasitic ground element has a length that extends from the linear edge to approximately the same distance from the edge as the exterior side of the elongated leg of the antenna element. A second parasitic ground element extends perpendicularly from the linear edge on the opposite side of the first parasitic element from the antenna element. The second parasitic ground element is adjacent to and substantially in parallel with the first parasitic ground element, which thereby defines a third dielectric gap therebetween. The second parasitic ground element has a length that is shorter then the first parasitic ground element length.

In a specific embodiment of the foregoing antenna apparatus, the ground plate, the antenna element, the first parasitic ground element, and the second parasitic ground element are fabricated as conductive etchings on a printed circuit board substrate. In another embodiment, the ground plate, the antenna element, the first parasitic ground element, and the second parasitic ground element are fabricated from metallic plate material.

In another specific embodiment of the foregoing antenna apparatus, the ground plate has an elongated form with the edge defining a side having a length that is substantially longer than the elongated leg of the antenna element, and a width that less than one-quarter of the length. In another embodiment, the antenna element base leg and elongated leg have a width that is approximately seven percent of their combined length, and the triangulated portion is formed exclusive of the width of the base leg and the elongated leg. In a refinement to this embodiment, the first parasitic ground element has a rectangular form with a width that is substantially equal the width of the antenna element base leg and elongated leg, and the second parasitic ground element has a rectangular form with a width that is substantially equal the width of the antenna element base leg and elongated leg. In another embodiment, the triangulated portion is bounded by a base side corresponding to the base leg, and elongated side corresponding to the elongated leg, and a hypotenuse side. The hypotenuse side is defined by two line segments intersecting at an obtuse external angle.

In a particular embodiment of the antenna apparatus, where the design broadband frequency range is 470 MHz to 900 MHz, the apparatus is configured as follows. The base leg of the antenna element has a length of 71 mm and a width of 14.5 mm, and the elongated leg of the antenna element has a length of 141 mm and a width of 15 mm. The triangulated portion of the antenna element extends through 91 mm of the length of the elongated leg, as measured from the outside corner. The first gap is 5 mm, and the second gap is 2.5 mm. The first parasitic ground element is 76 mm long and 14.5 mm wide, the third dielectric gap is 3 mm wide, and the second parasitic ground element is 64 mm long and 14.5 mm wide.

In another specific embodiment of the foregoing antenna apparatus, the first dielectric gap width, the first parasitic ground element size, and the second dielectric gap width are selected to broaden the bandwidth of the antenna element so as to yield an input impedance at the radio frequency feed point optimized to match a feed line impedance, and the second parasitic ground element size and location are selected to further broaden the bandwidth of the antenna element without significantly degrading the optimized match of the feed line impedance.

In another specific embodiment of the foregoing antenna apparatus, which is adapted for television reception in the UHF band of 470 MHz to 900 MHZ, and adapted to additionally receive the television VHF band, the apparatus further includes a radio frequency output connector electrical coupled to the radio frequency feed point through a coaxial cable. There is a pair of telescopic rabbit-ear antenna coupled through a 1:1 balun and a low pass filter to the radio frequency output connector. A housing is adapted to support the antenna apparatus and the pair of telescopic rabbit ear antenna. In a refinement to this embodiment, the housing is configured to appear as a picture frame, and further includes a means to engage a picture.

The present invention also teaches a broadband antenna apparatus that is generally disposed along a plane. The antenna apparatus includes a ground plate with a linear edge that is disposed along the plane. It has an antenna element disposed along the plane with a base leg at right angle to an elongated leg, which defines an exterior "L" shape corner and an interior corner. The interior corner is filled with a triangulated portion through substantially the entire length of the base leg and through a portion greater than fifty percent of the length of the elongated leg, which broadens the bandwidth of the antenna element. The antenna element has a radio frequency feed point located adjacent to the distal end of the base leg. The elongated ground plate and the antenna element are oriented such that the distal end of the base leg is positioned adjacent to the linear edge, forming a dielectric gap therebetween, and also oriented such that the elongated leg of the antenna element is arranged substantially in parallel to the edge. The apparatus includes a first parasitic ground element that has a first portion extending from the linear edge, which is adjacent to and in parallel with the exterior side of the base leg of the antenna element. The first portion has a length that extends beyond the exterior side of the elongated leg of the antenna element. The first parasitic ground element also includes a second portion extending at right angle from the first portion, and adjacent to and in parallel with the exterior side of the elongated leg of the antenna element. The antenna apparatus also includes a second parasitic ground element that has a first portion connected at right angle to a second portion, which defines an interior corner and an exterior corner. The first portion extends perpendicularly from the linear edge on the opposite side of the antenna element from the first parasitic element, and the second portion extends adjacent to and in parallel with the exterior side of the elongated leg of the antenna element.

In a specific embodiment of the foregoing antenna apparatus, the ground plate, the antenna element, the first parasitic ground element, and the second parasitic ground element are fabricated as conductive etchings on a printed circuit board substrate. In another embodiment, the distal end of the elongated leg of the antenna element has a 180 degree radius end, and the corner of the antenna element is rounded with the same radius. In another embodiment, the antenna element elongated leg has a width that is approximately 4.3 percent of the combined length of the base lend and the elongated leg.

In a specific embodiment of the foregoing antenna apparatus, the first portion and the second portion of the first parasitic ground element have the same width as the elongated leg of the antenna element, and the first portion and the second portion of the second parasitic ground element have the same width as the elongated leg of the antenna element. The ground plate has an elongated form where the edge defines a side that has a length that is substantially longer than the elongated leg of the antenna element plus the width of the first portion of the first parasitic ground element plus the width of the first portion of the second parasitic ground element. And, the elongated ground plate has a width that is less than one-tenth of the length. In a refinement to this embodiment, the first parasitic ground element and the second parasitic ground element each have a width that is substantially the same as the elongated leg of the antenna element, and the distal end of the first parasitic ground element has a 180 degree radius end, and the distal end of second first parasitic ground element has a 180 degree radius end, and the exterior corner between the first portion and the second portion of the first parasitic ground element and the second parasitic ground element are rounded with the same radius.

In a specific embodiment of the foregoing antenna apparatus, the first portion and the second portion of the second parasitic ground element are at right angle and form an interior corner, and the apparatus further includes a triangulated parasitic ground portion disposed upon this interior corner for a substantial portion of the length of the first portion and the second portion of the second parasitic ground element, thereby further broadening the bandwidth of the broadband antenna apparatus.

In a particular embodiment of the foregoing antenna apparatus, where the broadband frequency range is 174 MHz to 700 MHz, the apparatus is configured as follows. The base leg of the antenna element has a length of 70 mm and a width of 10 mm, and the elongated leg of the antenna element has a length of 254 mm and a width of 14 mm. The triangulated portion of the antenna element extends through 139 mm of the length of the elongated leg, measured from the outside corner. The first dielectric gap is 4 mm. The first portion and the second portion of the first parasitic ground element are 14 mm wide, the first portion is 70 mm long and the second portion is 90 mm long. The first portion and the second portion of the second parasitic ground element are 14 mm wide, the first portion is 160 mm long and the second portion is 104 mm long. The ground plate is 324 mm long and 30 mm wide, and the linear edge of the ground plate is 296 mm long.

In another specific embodiment of the foregoing antenna apparatus, where the broadband frequency range is 174 MHz to 700 MHz, the apparatus further includes a broadband radio frequency amplifier that has a usable gain range between 174 MHz and 700 MHz that is coupled to receive radio signals from the radio frequency feed point, and that has a radio frequency output for coupling to a radio signal feed line. In a refinement to this embodiment, the apparatus further includes a power supply circuit coupled to provide regulated power to a radio signal feed line that is coupled to the radio frequency output, and the broadband radio frequency amplifier is coupled to receive regulated power from the radio frequency output.

DESCRIPTION OF THE INVENTION

Figure 1:
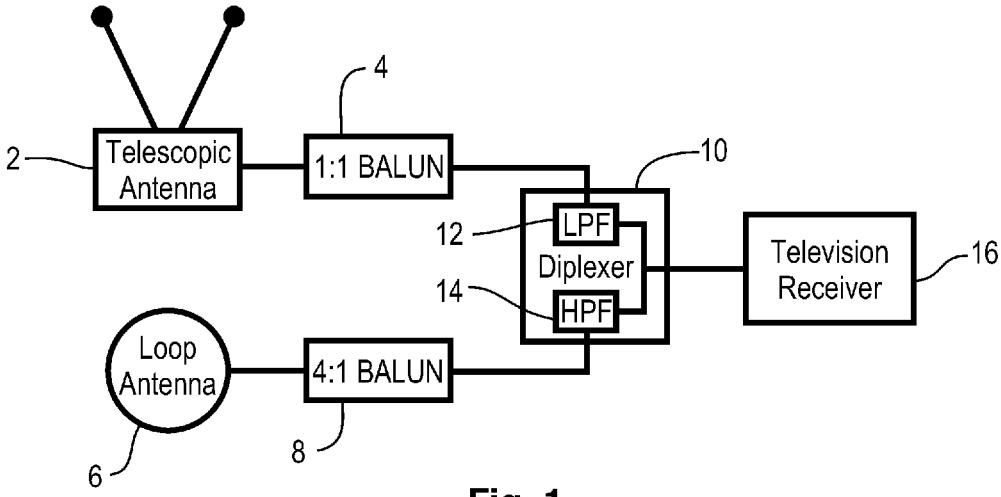
Fig. 1 Prior Art
FIG. 1 is a functional block diagram of a prior art television antenna system.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods and components to form various apparatus. Accordingly, the apparatus components and method steps have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

Reference is direct to FIG. 1, which is a functional block diagram of a prior art indoor, set-top, television antenna. The majority of prior art indoor antennas available in the market are essentially composed of two antennas, a 7.5 inch diameter UHF loop 6 coupled through a 4:1 ratio balun 8 and a pair of telescopic whips as a dipole antenna 2 coupled through a 1:1 balun 4. The telescopic whips 2, often referred to as "rabbit ears" have a natural feed point impedance in the 50/75 ohm range, so a 1:1 balun 4 is suitable for coupling to unbalanced 50/75 ohm coaxial feed line. The UHF loop 6 has a natural unbalanced feed point impedance in the 300 ohm range, so a 4:1 balun 8 is needed to adapt to the 50/75 ohm unbalanced feed lines used on most TV antenna systems. The gain of the UHF loop element 6 is approximately 2 dBi on its main axis. The TV signals received by the UHF loop 6 and the VHF telescopic antenna 2 are combined by a diplexer 10. The diplexer 10 consists of a low pass filter 12 on the VHF element signal, and a high pass filter 14 on the UHF element signal. This filter arrangement effectively isolates the signals from the two antenna elements from one another. The insertion of the passive baluns and the passive diplexer 10 attenuates the received signals. The output of the diplexer 10 is coupled to a television receiver 16, typically through a 50/75 ohm coaxial cable.

The prior art antenna of FIG. 1 provides modest antenna performance, but with significant attenuated signal loss through the baluns and diplexer filters. In order to improve the signal performance for HDTV purposes, the attenuated signal loss of the UHF band should be reduced. Techniques for accomplishing this goal is to eliminate the 4:1 balun and the high pass filter in the diplexer, thereby eliminating those attenuation losses. This requires an unbalanced antenna element that has a feed point impedance in the 50/75 ohm range. Examples of such antennas are the prior art inverted "L", inverted "F", and various length monopole antennas. However, none of these antennas possess the requisite compact size, adequate bandwidth, and gain performance needed to be viable as a consumer marketed product. The present invention overcomes this limitation in the prior art with various novel antenna element and antenna system structures.

Figure 2:
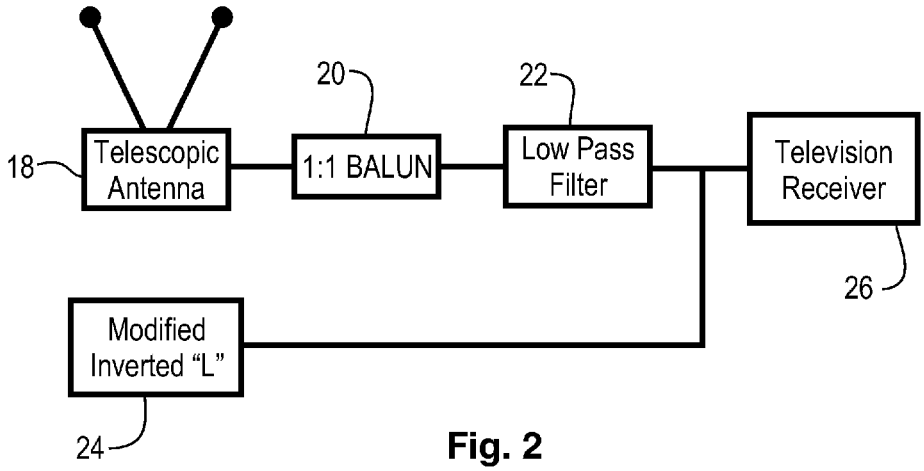
FIG. 2 is a functional block diagram of a dual-band indoor high definition television antenna system according to an illustrative embodiment of the present invention.

Reference is direct to FIG. 2, which is a functional block diagram of a dual-band indoor high definition television antenna system according to an illustrative embodiment of the present invention. The antenna element employed in this illustrative embodiment is a modified inverted "L" antenna 24, which will be more fully discussed hereinafter. This antenna 24 presents an unbalanced feed point in the 50/75 ohm range, and also has the natural characteristic of a high pass filter with respect to the UHF/VHF bands, so as to promote the isolation of UHF and VHF signals. The system of FIG. 2 includes a conventional VHF antenna, which is a pair of extendable whips 18. The VHF antenna 18 is coupled through a 1:1 balun 20 and a low pass filter 22 before combination with the directly coupled signal from the modified inverted "L" element 24. The combined signals are fed directly to a TV receiver 26. Note that the combination of the high pass filter characteristic of the modified inverted "L" element 24 and the low pass filter 22, result in the diplexer function of the prior art design, although without the attenuated loss of the prior art design. The modified inverted "L" element 24 is an improved derivation of the traditional inverted "L" antenna and its polarization is horizontal, which matches the polarization of the HDTV UHF band channels in the United States.

Figure 3:
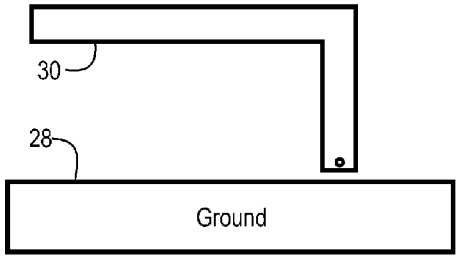
Fig. 3 Prior Art
FIG. 3 is a drawing of a prior art inverted "L" antenna.

Reference is direct to FIG. 3, which is a drawing of a prior art inverted "L" antenna. Inverted "L" antennas are known in the art, and can be configured as in FIG. 3 as a ground plane 28 with an "L" shaped antenna 30 whose length comprises a base leg and an elongated leg, and has a size based on approximately ¼ wavelength of the design center frequency. The feed point is generally positioned at the distal end of the base leg of the "L" shaped element 30. As a resonant structure based on its physical size, the prior art inverted "L" antenna element performs as a narrow bandwidth antenna with relatively large size when compared to prior art UHF loop antennas. Thus, it cannot fulfill the market requirements of small size and large operating bandwidth (from 470 MHz to 900 MHz) required for the HDTV indoor antenna market.

Figure 4:
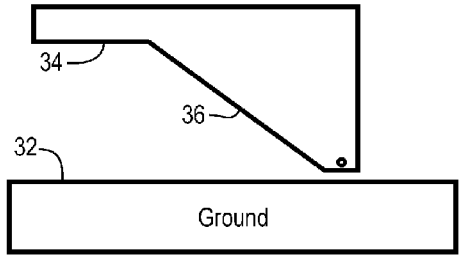
FIG. 4 is a drawing of broadband modified inverted "L" antenna according to an illustrative embodiment of the present invention.

Reference is direct to FIG. 4, which is a drawing of broadband modified inverted "L" antenna according to an illustrative embodiment of the present invention. This illustrative embodiment modifies the prior art inverted "L" antenna design by adding a triangulated portion 36 to the interior corner of the "L" shaped element 34, which is positioned adjacent to a ground plate 32. The triangulated portion 36 fills the interior corner for substantially the entire length of the base leg and a substantial portion of the length of the elongated leg of the "L" shaped antenna element 34. This modification can broaden the bandwidth by about 50%, however, this is still inadequate to meet the particular design requirements of the 470 MHz to 900 MHz UHF band of interest. Further modifications are added to broaden the bandwidth.

Figure 5:
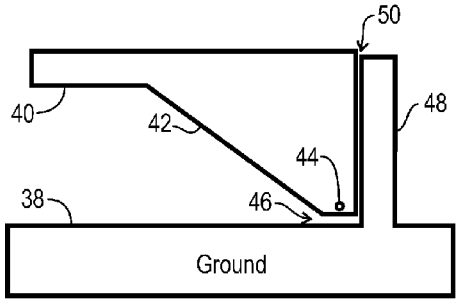
FIG. 5 is a drawing of broadband modified inverted "L" antenna according to an illustrative embodiment of the present invention.

Reference is direct to FIG. 5, which is a drawing of broadband modified inverted "L" antenna according to an illustrative embodiment of the present invention. The performance of the illustrative embodiment of FIG. 4 is improved with the modifications added in FIG. 5. The antenna element 40 incorporates the aforementioned triangulated portion 42, and remains positioned over a ground plate 38. The antenna feed point 44 is located adjacent to the distal end of the "L" shaped element 40 base leg. A parasitic ground strip 48 is added directly adjacent to the exterior of the base leg of the "L" shaped element 40. The dielectric gap 46 between the base leg of the "L" shaped element 40 and the ground plate 38 is carefully selected to manage bandwidth, VSWR, and gain of the antenna structure. Similarly, the dielectric gap 50 between the base leg of the "L" shaped element 40 and the parasitic ground strip 48 is carefully selected to manage bandwidth, VSWR, and gain of the antenna structure. With the addition of the first parasitic ground strip 48, the bandwidth and performance is improved, however it is still not wideband enough for the UHF radio band of interest. Further modifications to the illustrative embodiment are added.

Figure 6:
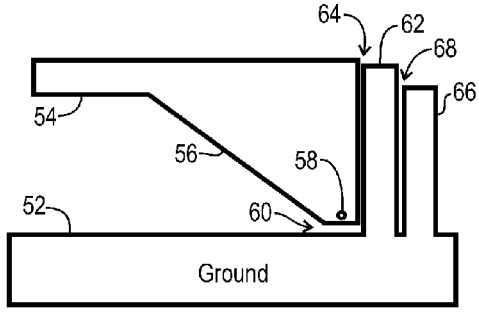
FIG. 6 is a drawing of broadband modified inverted "L" antenna according to an illustrative embodiment of the present invention.

Reference is direct to FIG. 6, which is a drawing of broadband modified inverted "L" antenna according to an illustrative embodiment of the present invention. In this refinement to the prior illustrative embodiment, the "L" shaped antenna element 54 includes a triangulated portion 56 on the inside corner of the "L" shaped element 54, with a feed point 58 at the distal end of the base leg. The antenna element is spaced from the ground plate 52 by a dielectric gap 60, and is spaced away from a first parasitic ground strip 62 by a second dielectric gap 64. In this embodiment, a second parasitic element 66 is positioned adjacent to the first parasitic element 62, and spaced apart with a third dielectric gap 68. The second parasitic ground strip 66 is shorter than the first parasitic ground strip 62. Performance tests demonstrate that this illustrative embodiment exhibits a bandwidth that is wide enough to cover the UHF HDTV band and that it also provides good VSWR across the band of interest, and improved gain along the main axis of the antenna. As noted hereinbefore, the inverted "L" is the basic design, and then the interior of the "L" is triangulated 56 to broaden the bandwidth, as a fatter "L" provides broader bandwidth. The parasitic ground elements are employed as distributed capacitors to match the antenna impedance to 50/75 ohms at those frequencies, and to provide low VSWR/reflection. This matching process is accomplished using empirical techniques in combination with repeated performance testing. The second parasitic element 66 is shorter than the first 62, because if the second parasitic element 66 were longer than the first 62, it would yield a large capacitive effect that would greatly alter the impedance matching process employed for the first parasitic element 62. Note that the spacing between elements is determined empirically by monitoring the VSWR of the antenna such that the maximum possible bandwidth is achieved.

Figure 7:
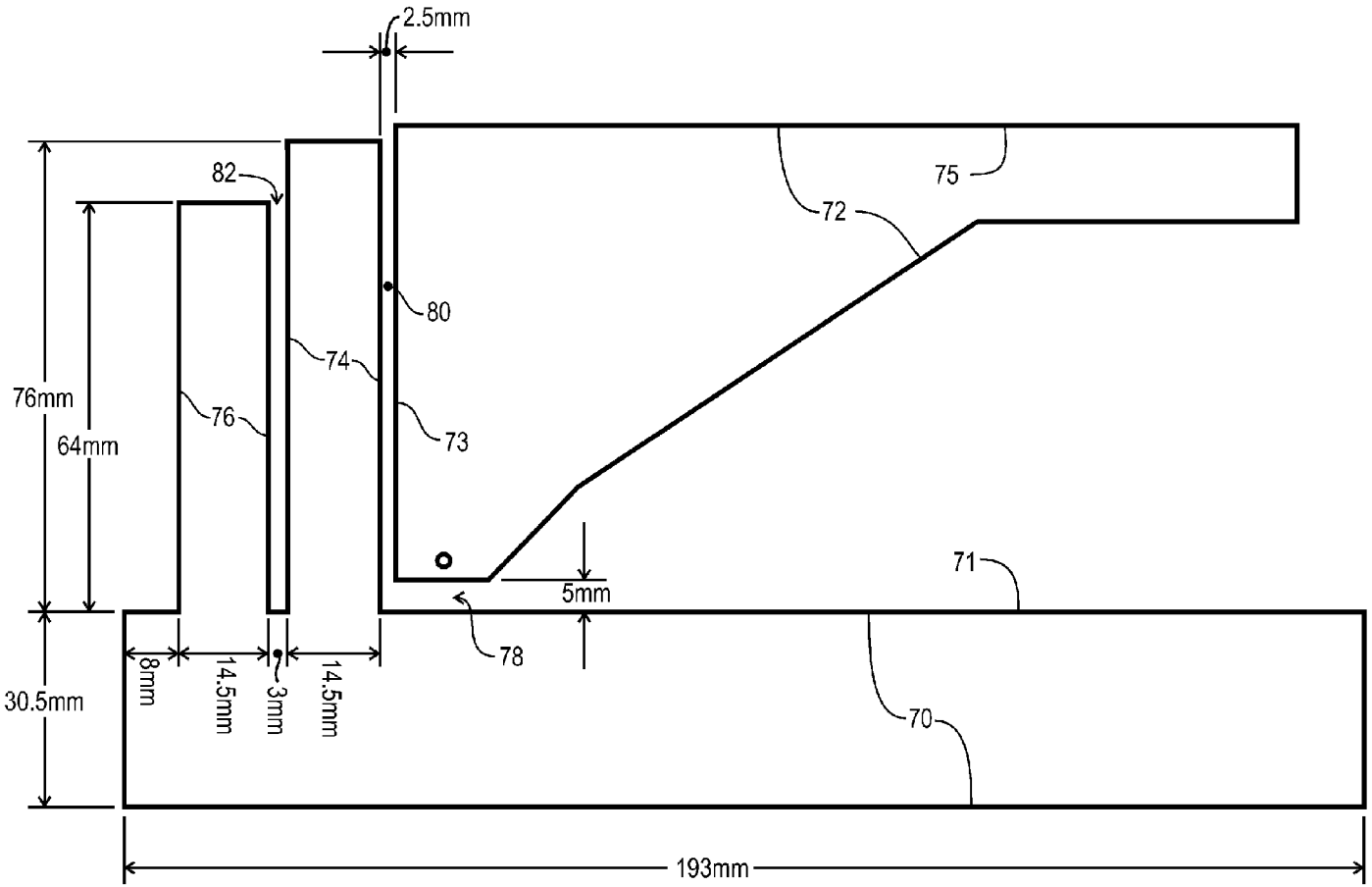
FIG. 7 is a drawing of broadband modified inverted "L" antenna according to an illustrative embodiment of the present invention.

Reference is direct to FIG. 7, which is a drawing of broadband inverted "L" antenna according to an illustrative embodiment of the present invention. The specific physical dimensions or the illustrative embodiment antenna are presented in FIG. 7. The total overall size is 10.65 cm in height and 19.3 cm in width, which is nearly 4.2 inches by 7.6 inches, yielding a total area of approximately 32 square inches. This form factor is substantially smaller than the area of the 7.5" loop antenna, and also presents a more favorable and compact form, particularly since it is rectangular as opposed to round. In the illustrative embodiment, the antenna is flat, lying along a geometric plane. The construction of the antenna can be implemented with any suitable thin metallic conductive material, such as metal plates, sheet metal, or metalized printed circuit board substrate.

FIG. 7 includes specific dimensions for the illustrative embodiment, which were developed specifically for the HDTV UHF operating band of frequencies, including some tolerance for manufacturing practicalities and potential use in countries where the higher ranges of the UHF band (i.e. 698 MHz-900 MHz) are still in operation. The ground plate 70 is a 30.5 mm by 70 mm elongated rectangle with a linear edge 71 on the top. A first parasitic ground element 74 extends perpendicularly from the linear edge and is also an elongated rectangle this is 76*m* long and 14.5 mm wide. A second parasitic ground element 76 extends perpendicularly from the edge of the ground plate 70, and is aligned in parallel with the first parasitic ground element 74. The second dielectric ground element is also an elongated rectangle, 64 mm in length and 14.5 mm wide. The parasitic ground elements are separated by a 3 mm dielectric gap 82. The modified inverted "L" antenna element 72 is positioned with the exterior side 73 of its base leg adjacent to and in parallel with the first parasitic ground element 74, and separated by a 2.5 mm dielectric gap 80. The distal end of the base leg of the modified inverted "L" antenna 72 is positioned adjacent to the edge of the ground plate 70, and separated by a 5 mm dielectric gap. The elongated leg 75 of the modified inverted "L" antenna element 72 is in parallel with the edge 71 of the ground plate 70.

Figure 8:
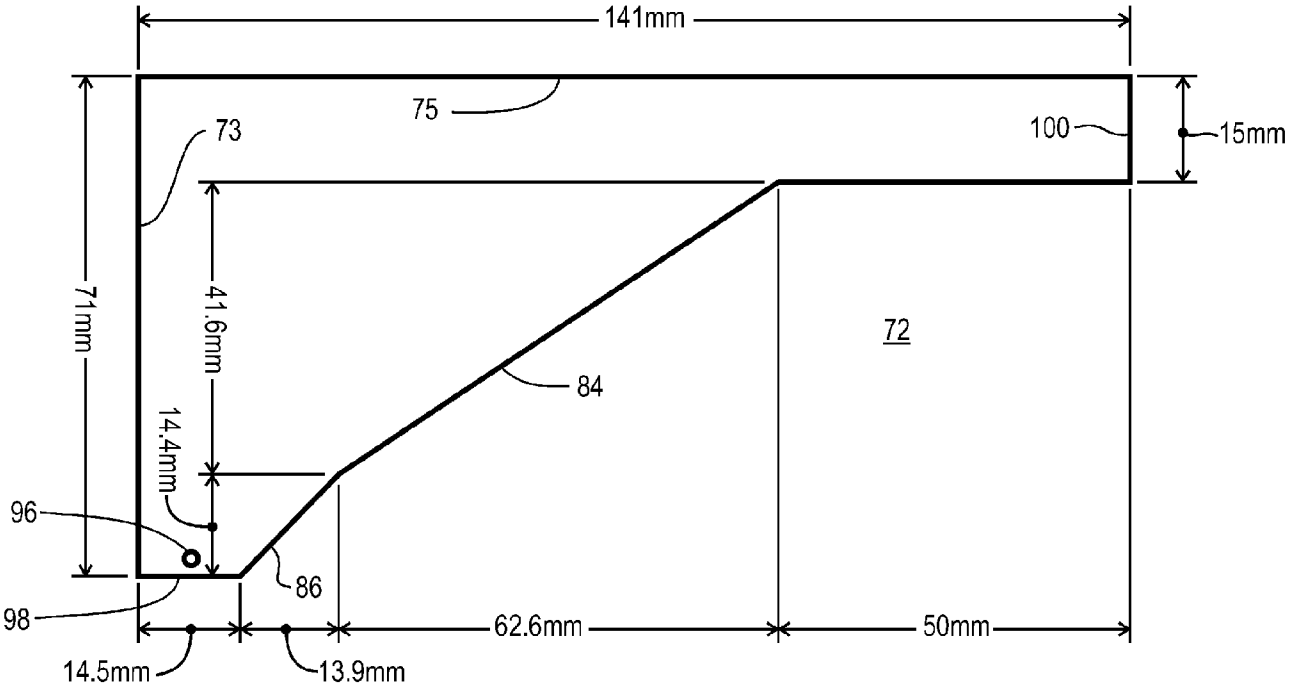
FIG. 8 is a drawing of the radiating element in a broadband modified inverted "L" antenna according to an illustrative embodiment of the present invention.

Reference is direct to FIG. 8, which is a drawing of the modified inverted "L" radiating element in a broadband modified inverted "L" antenna according to an illustrative embodiment of the present invention. FIG. 8 separately details the radiating antenna element 72 discussed in FIG. 7. FIG. 8 presents the specific dimensions of the illustrative embodiment modified inverted "L" 72. The base leg 73 is 71 mm long and 14.5 mm wide at the distal end 98. The antenna feed point 96 is located adjacent to the distal end 98. The elongated leg 75 is 141 mm long and 15 mm wide 100. The triangulated portion is defined by two line segments 84, 86 that intersect at an obtuse external angle. The triangulated portion extends from substantially the entire length of the base leg 73 through more than 50% of the length of the elongated leg 75. The precise dimensions are presented in FIG. 8.

Figure 9:
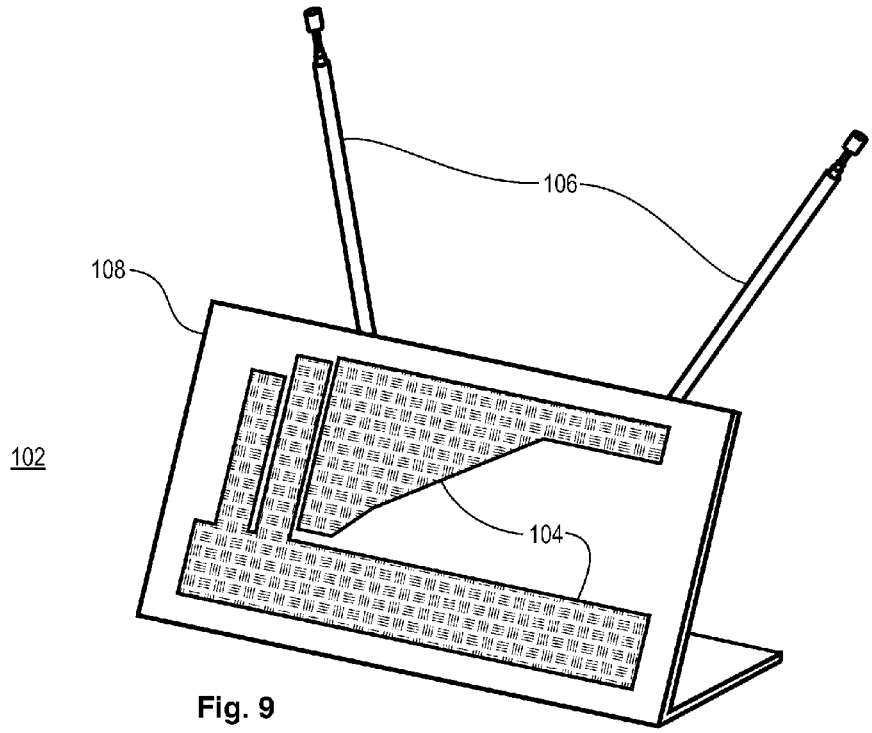
FIG. 9 is a drawing of a dual-band indoor high definition television antenna according to an illustrative embodiment of the present invention.

Reference is direct to FIG. 9, which is a drawing of a dual-band indoor high definition television antenna 102 according to an illustrative embodiment of the present invention. The illustrative embodiment in FIG. 9 is exemplary of a simple set-top indoor antenna system 102. A dielectric stand 108 supports the modified inverted "L" antenna 104 for the UHF band, and a pair of telescopic dipole elements 106 for the VHF band. The elongated leg of the modified inverted "L" element is oriented horizontally, which results in a horizontally polarized antenna. This is quite suitable for use in receiving the horizontally polarized UHF HDTV channels in the United States. Also note that since the balun and the high pass filter in the diplexer are eliminated by virtue of the modified inverted "L" design (discussed hereinbefore), the gain of this antenna is at least 2 dB better than a traditional UHF loop antenna. In addition, this antenna has a size advantage over the traditional loop antenna because it is more compact.

Figure 10:
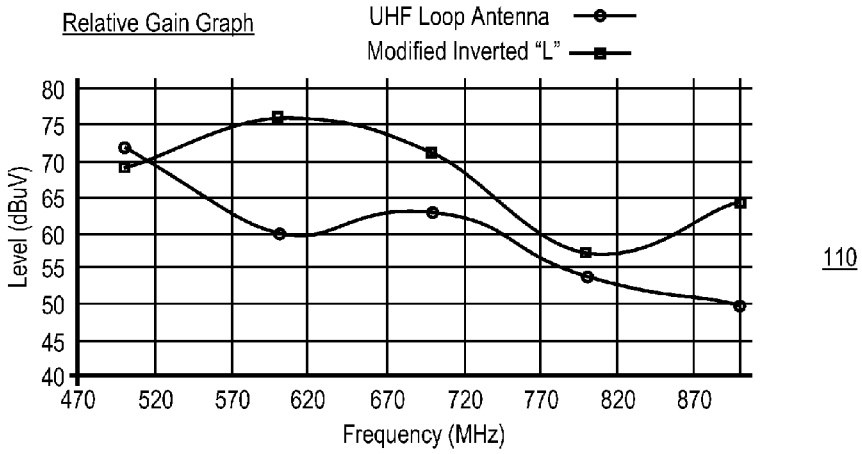
FIG. 10 is a relative gain graph of a high definition television antenna according to an illustrative embodiment of the present invention.

Reference is direct to FIG. 10, which is a relative gain graph 110 of a high definition television antenna according to an illustrative embodiment of the present invention. The gain graph 110 corresponds to the modified inverted "L" antenna of FIG. 7 and FIG. 8, and also illustrates the measured gain for a 7.5" UHF loop antenna. The measurements are taken at various frequencies across the UHF television band, which clearly shows the superior performance of the illustrative embodiment antenna. The improved performance is 7.6 dB on average.

Figure 11:
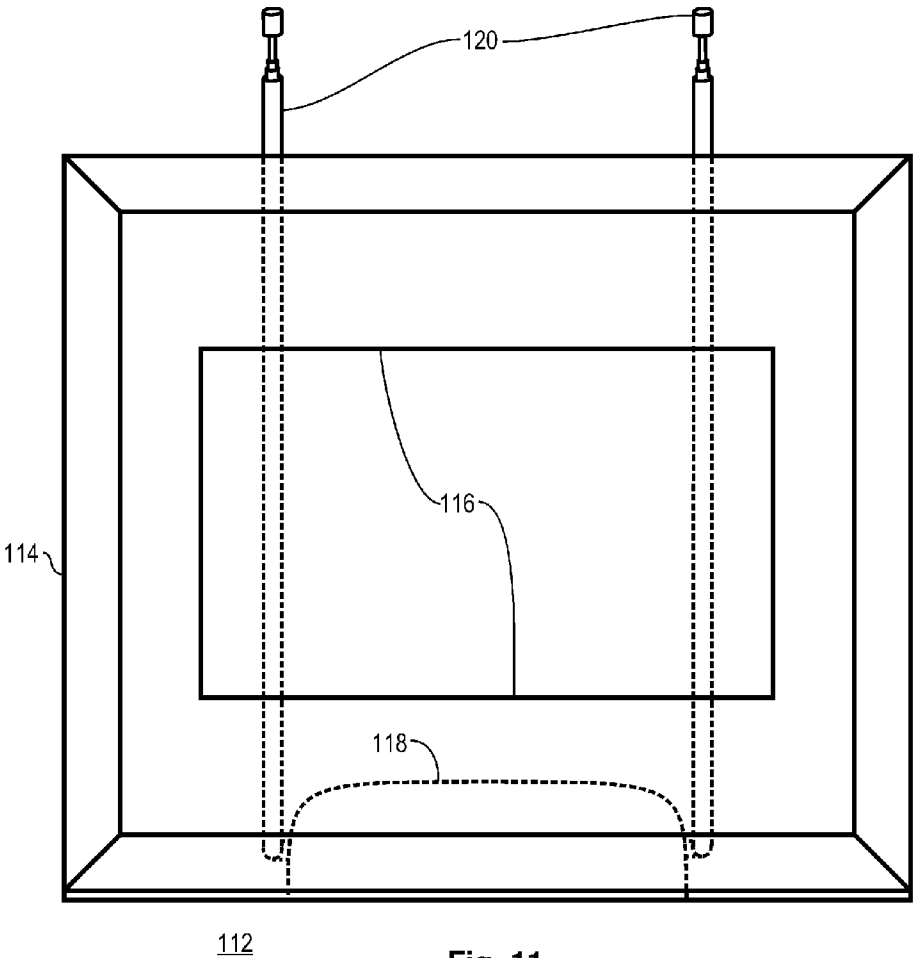
FIG. 11 is a front view drawing of a dual-band indoor high definition television antenna according to an illustrative embodiment of the present invention.
Figure 12:
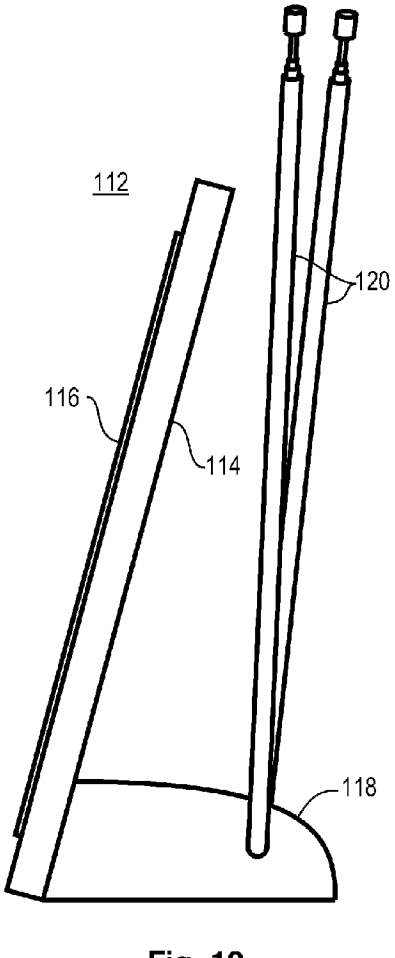
FIG. 12 is a side view drawing of a dual-band indoor high definition television antenna according to an illustrative embodiment of the present invention.

Reference is direct to FIG. 11 and FIG. 12, which are a front view drawing and a side view drawing, respectively, of a dual-band indoor high definition television antenna according to an illustrative embodiment of the present invention. This illustrative embodiment is configured as a decorative picture frame 112 antenna. The outer frame 114 has the appearance of a picture frame, and includes a clear plastic means for retaining a picture 116 on the front. All of the structure is fabricated from a dielectric material, and the UHF antenna elements are concealed inside (not shown). A base structure 118 rests on a horizontal surface, and supports the rabbit ear dipole VHF elements 120. This embodiment presents an attractive, compact, affordable and highly marketable consumer indoor antenna product.

Figure 13:
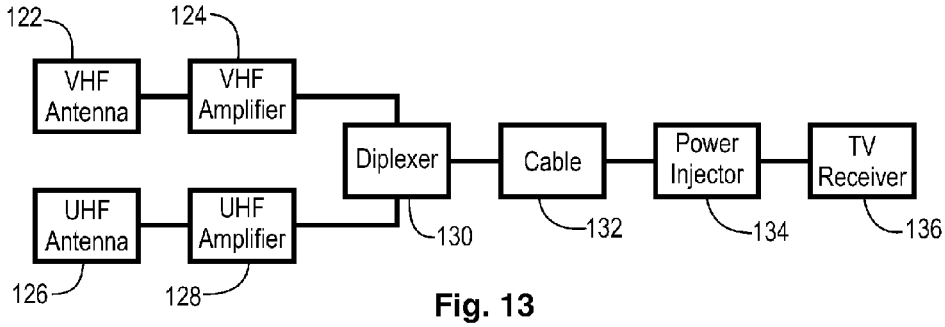
Fig. 13 Prior Art
FIG. 13 is a functional block diagram of a prior art television antenna system.

Reference is direct to FIG. 13, which is a functional block diagram of a prior art outdoor television antenna system. The outdoor antenna is typically mounted to a mast that is position above the building and other local obstacles so a clear signal can be received. Such antennas are basically comprised of two separate antenna elements, a VHF section 122 and a UHF section 126. Since the antennas are located outdoors, a long feed line cable 132 is required to connect the signals to a television receiver 136. Therefore, prior art designs have employed RF amplifiers, including a VHF amplifier 124 and a UHF amplifier 128 dedicated to the respective frequency bands. Since these amplifiers 124,128 are used to compensate for attenuating feed line 132 losses, they are located near the antenna elements 122,126. Before the amplified signals are fed into the feed line 132, a diplexer 130 is needed to isolate the antenna elements, one from the other, to effectively combine them. A power injector circuit 134 applies DC power for the amplifiers, and is coupled through the feed line 132, and is injected indoors, near the television receiver 136. The disadvantage of the prior art design is the need for dual antenna elements, dual RF amplifiers, and the attenuation of signals introduced by the diplexer, or other combining circuitry.

Figure 14:
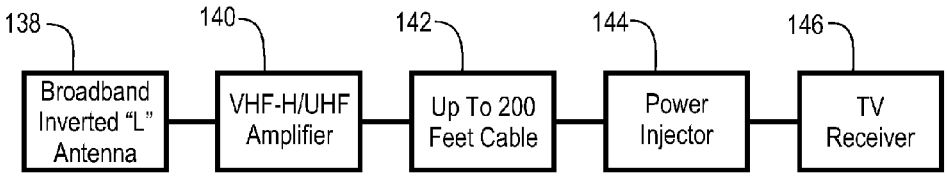
FIG. 14 is a functional block diagram of an outdoor high definition television antenna system according to an illustrative embodiment of the present invention.

Reference is direct to FIG. 14, which is a functional block diagram of a high definition television antenna system adapted for outdoors installation according to an illustrative embodiment of the present invention. The invention utilizes a broadband modified inverted "L" antenna 138 that is fabricated as a flat panel circuit to yield a compact design that is easily installed, is suited for a wide variety of installation locations, and that is more attractive than prior art antenna system structures. The modified inverted "L" antenna 138 is designed to cover the band including both the VHF-H and UHF bands. The antenna signal is coupled through a single RF amplifier that also has adequate bandwidth to cover both the VHF-H and UHF bands. The gain of the amplifier 140 is approximately 20 dB, which can support a feed line cable 142 with a length of up to 200 feet. Since the amplifier 140 is broadband, it does not include a diplexer circuit so there is no resultant attenuation from such a circuit. A power injector 144 is coupled to the cable 142 near the television receiver, on the indoor end of the system, to provide raw DC power to the RF amplifier 140.

Figure 15:
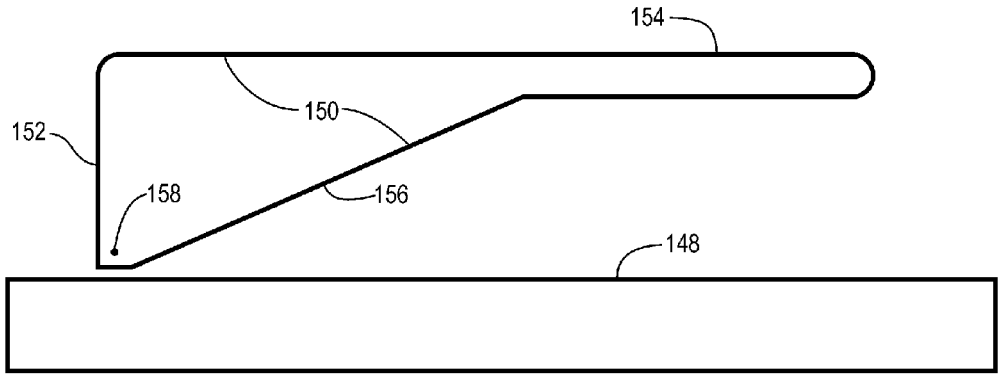
FIG. 15 is a drawing of broadband modified inverted "L" antenna according to an illustrative embodiment of the present invention.

Reference is direct to FIG. 15, which is a drawing of broadband modified inverted "L" antenna according to an illustrative embodiment of the present invention. The design of this illustrative embodiment design begins with an inverted "L" element 150 located adjacent to a ground plate 148. The base leg 152 has an RF feed point 158 located at its distal end. An elongated leg 154 extends horizontally with respect to the upper edge of the ground plate 148. The inverted "L" element 150 and the ground plate 148 are both aligned along a common plane. The antenna element is dimensioned to be resonant within the UHF band of interest. Since the bandwidth of a simple inverted "L" is not wide enough to receive the needed portion of the VHF-H and UHF bands employed in HDTV, the interior corner of the "L" has a triangulated portion 156 added so as to widen the bandwidth. The triangular portion extends from substantially the entire length of the base leg 152 to a length that is over 50% of the elongated leg 154 length. The precise size of the triangulated portion 156 is optimized with empirical methods and testing for actual VSWR, impedance, and gain across the band of interest.

Figure 16:
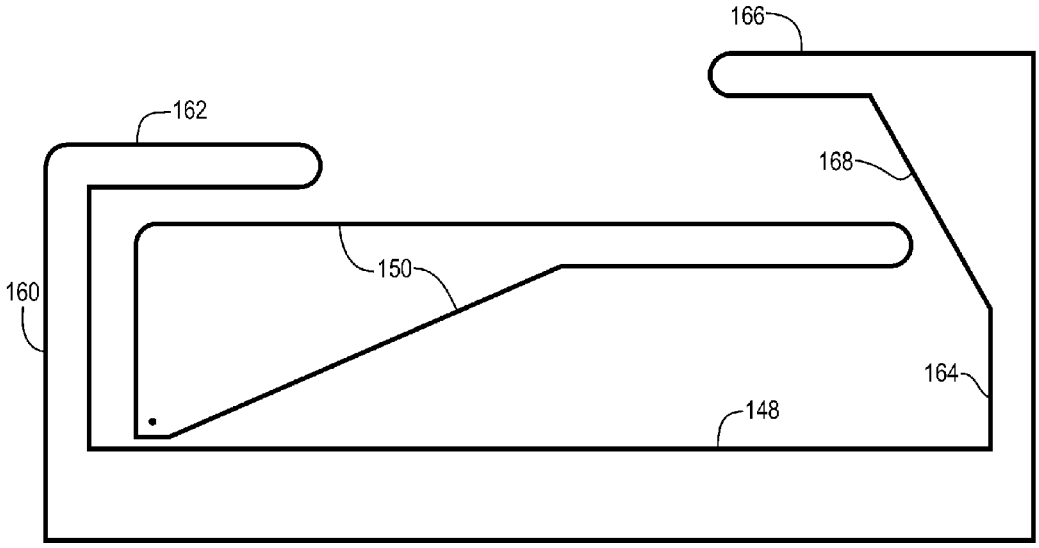
FIG. 16 is a drawing of broadband modified inverted "L" antenna according to an illustrative embodiment of the present invention.

Reference is direct to FIG. 16, which is a drawing of broadband modified inverted "L" antenna according to an illustrative embodiment of the present invention. The bandwidth achievable with the antenna structure of FIG. 15 is not adequate for the required band of operation in the illustrative embodiment. The bandwidth is further increased in FIG. 16 by adding a first parasitic ground element 160/162 and a second parasitic ground element 164/166. The additional elements enable the single antenna structure to receive the UHF band from at least 470 MHz to 700 MHZ and the VHF-H band from at least 174 MHz to 220 MHz. The first parasitic ground element includes two portions, a first portion 160 that extends perpendicularly from the edge of the ground plate 148 and a second portion 162 that extends parallel to the edge 148 and parallel to the elongated leg of the inverted "L" element 150. The second parasitic ground element includes a first portion 164 that extends perpendicularly from the edge o the ground plate 148 and a second portion 166 that extends parallel to the edge 148 and in parallel with the elongated leg of the antenna element 150. These two portions 164, 166 form a right angle defining an interior corner. The interior corner includes an added triangulated portion 168. The first and second parasitic ground elements are "L" shaped, however, the purpose of this form is to maintain a compact form of the antenna system, which is desirable from a product and marketing perspective.

The structure illustrated in FIG. 16 matches the feed point impedance with that of an unbalanced coaxial feed line of 50-75 ohms. The balancing of bandwidth, impedance and gain is optimized using empirical methods as are known to those skilled in the art. The VSWR of the illustrative embodiment remains below 3:1 in the VHF-H band and the UHF band. This illustrative embodiment antenna can be fabricated as either a printed circuit board etching or from sheet metal, since the dimensions are relatively small when compared to prior art yagi or log-periodic antenna structures. The elongated leg of the modified inverted "L" element 150 is horizontal, which is suitable to receive horizontal polarized UHF HDTV channels in the US markets. On the other hand, the VHF-H channels employ vertical polarization, and to accommodate this fact, the second parasitic ground element 164/166 serves to partially receive the VHF-H frequency band in combination with the antenna element 150. The interior triangulated portion 168 of the second parasitic element 164/166 serves to broaden the bandwidth of the VHF-H band while still maintaining a compact overall form of the antenna structure.

Figure 17:
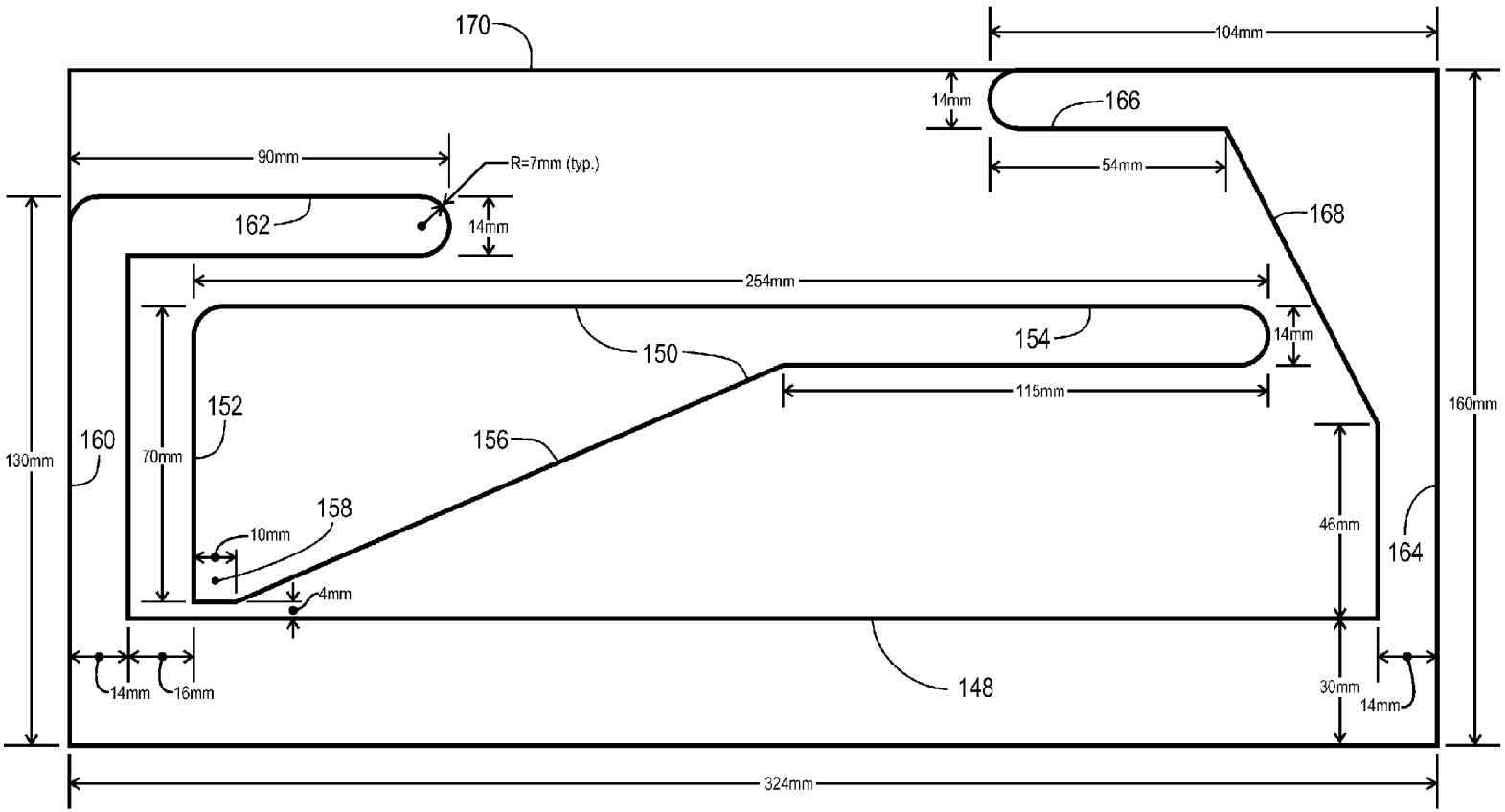
FIG. 17 is a drawing of broadband modified inverted "L" antenna according to an illustrative embodiment of the present invention.

Reference is direct to FIG. 17, which is a drawing of broadband modified inverted "L" antenna system according to an illustrative embodiment of the present invention. FIG. 17 provides the specific dimensions of the antenna system for operation in the VHF-H band (147 MHz-22 MHz) and the UHF band (470 MHz to (700 MHz). The system is etched from a clad printed circuit board 170 that is 324 mm wide and 160 mm tall. The ground plate 148 is 324 mm wide and 30 mm tall. The first parasitic ground element includes a first portion 160 that is 14 mm wide and extends 130 mm to the second portion 162 that is 14 mm wide and extends 90 mm along the horizontal. The distal end of the second portion 162 is rounded with a 7 mm radius, which is typical for all the rounded corners in the antenna system. The second parasitic ground element includes a first portion 164 that is 14 mm wide and extends to 160 mm, and a second portion 166 that is 14 mm wide and extends 104 mm to a rounded distal end with a 7 mm radius. The interior corner includes a triangulated portion 168, dimensioned as illustrated. The antenna element 150 is disposed within the confines of the first and second parasitic ground elements. The base leg is 70 mm and the elongated leg is 254 mm. The elongated leg is 14 mm wide, with a rounded distal end. The base leg is 10 mm wide with a feed point 158 adjacent to the distal end. The exterior corner of the modified "L" is rounded with a 7 mm radius. The distal end of the base leg 152 is positioned 4 mm from the edge 148 of the ground plate, thereby forming a dielectric gap. The bas leg 152 is spaced 16 mm from the interior edge of the first portion 160 of the first parasitic ground element.

Figure 18:
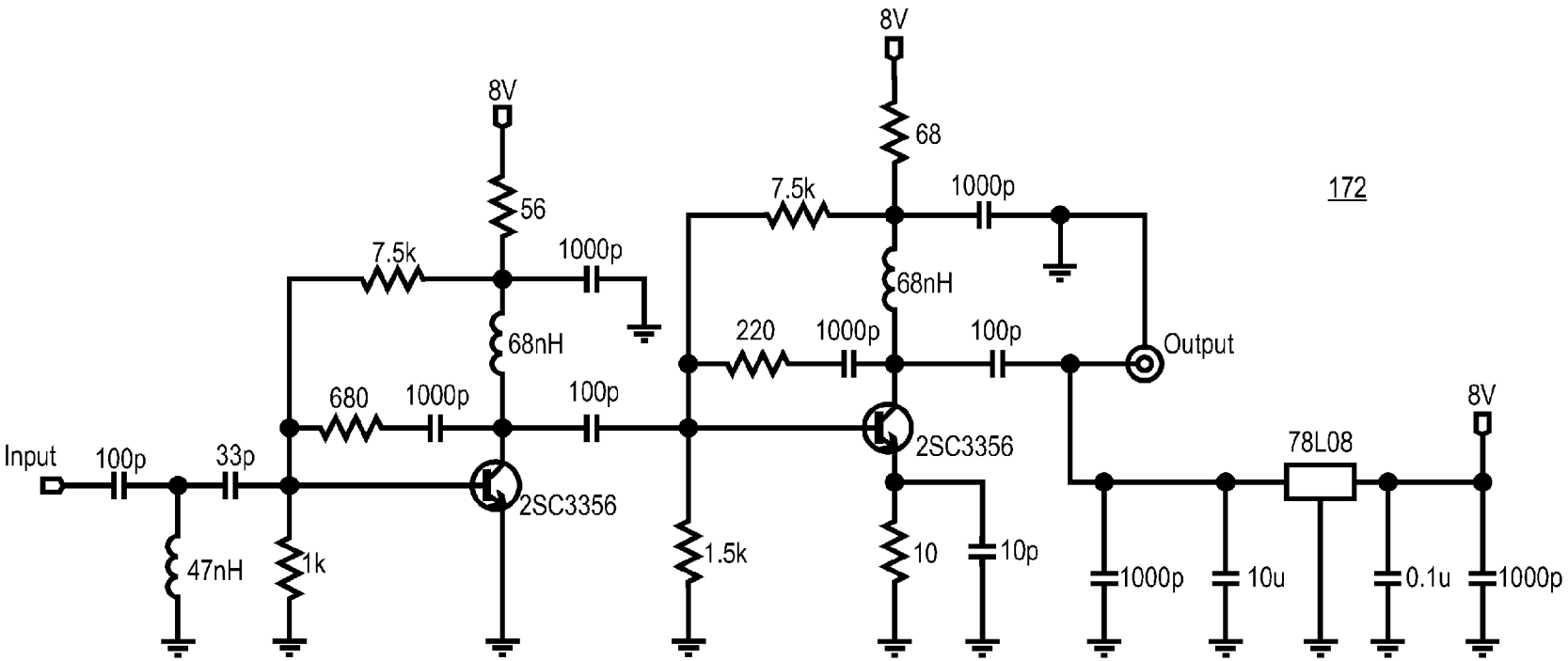
FIG. 18 is a schematic diagram of an RF amplifier for a broadband modified inverted "L" antenna system according to an illustrative embodiment of the present invention.

Reference is direct to FIG. 18, which is a schematic diagram of an RF amplifier for a broadband inverted "L" antenna system according to an illustrative embodiment of the present invention. The amplifier schematic circuit 172 is a two-stage tuned feedback amplifier that provides approximately 20 dB gain in the VHF-H band and UHF band of the antenna structure illustrated in FIG. 17. The circuit of FIG. 18 is co-located with the antenna structure, with the input of the amplifier 172 coupled to the feed point of the antenna structure. In the illustrative embodiment, the amplifier circuit is disposed on the same printed circuit board substrate as the antenna elements. The output of the amplifier circuit 172 is coupled to the coaxial feed line. The feed line is charged with 12 Volts DC, which provides raw power to the 8 volt voltage regulator in the amplifier circuit 172. The power is injected to the feed line near the television receiver, on the indoor side of the system. The schematic diagram of FIG. 18 is self-explanatory to those skilled in the art. Surface mount components are employed, resistance values are in ohms, capacitance values are in Pico farads (p) or microfarads (u), and inductance values are in nano Henries (nH).

Figure 19:
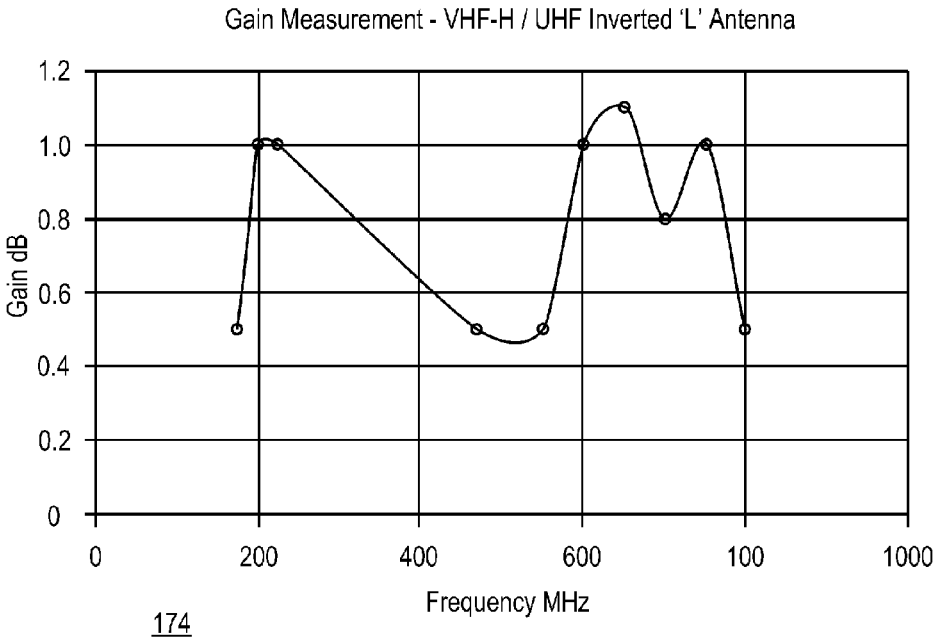
FIG. 19 is an antenna gain measurement diagram for a broadband modified inverted "L" antenna according to an illustrative embodiment of the present invention.
Figure 20:
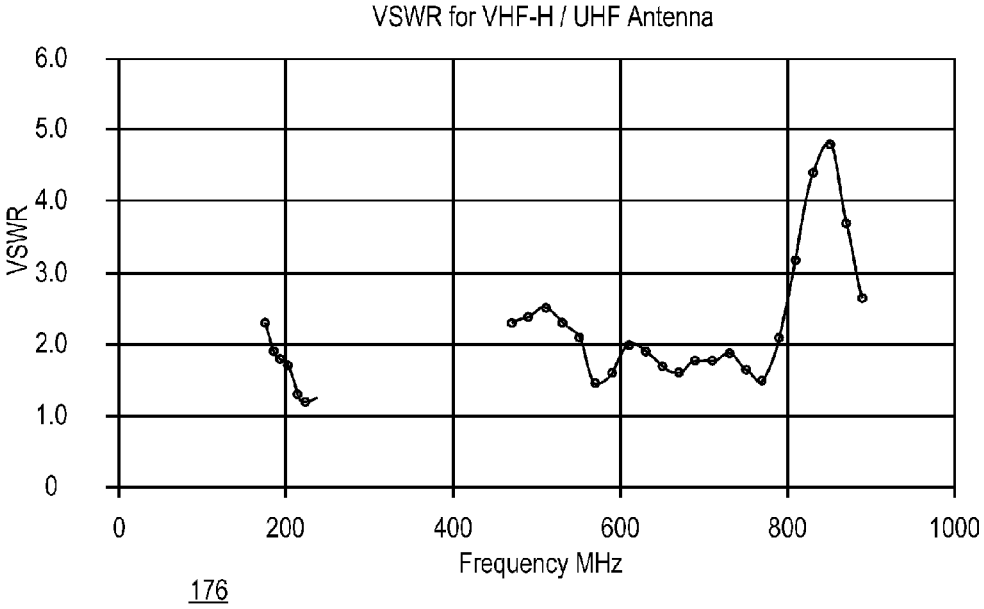
FIG. 20 is a VSWR diagram for a broadband modified inverted "L" antenna system according to an illustrative embodiment of the present invention.

Reference is direct to FIG. 19, which is an antenna gain measurement diagram 174 for a broadband inverted "L" antenna according to an illustrative embodiment of the present invention. The graph 174 corresponds to the antenna structure illustrated in FIG. 17. The gain performance in the VHF-H band and UHF band is maintained between 0.5 dB and 1.1 dB as compared to an isotropic radiator. FIG. 20 illustrates a VSWR graph 176 for the same antenna structure in the same bands of interest. As illustrated, VSWR performance remains below about 2.5:1 through out the bands, up to 700 MHz.

Figure 21:
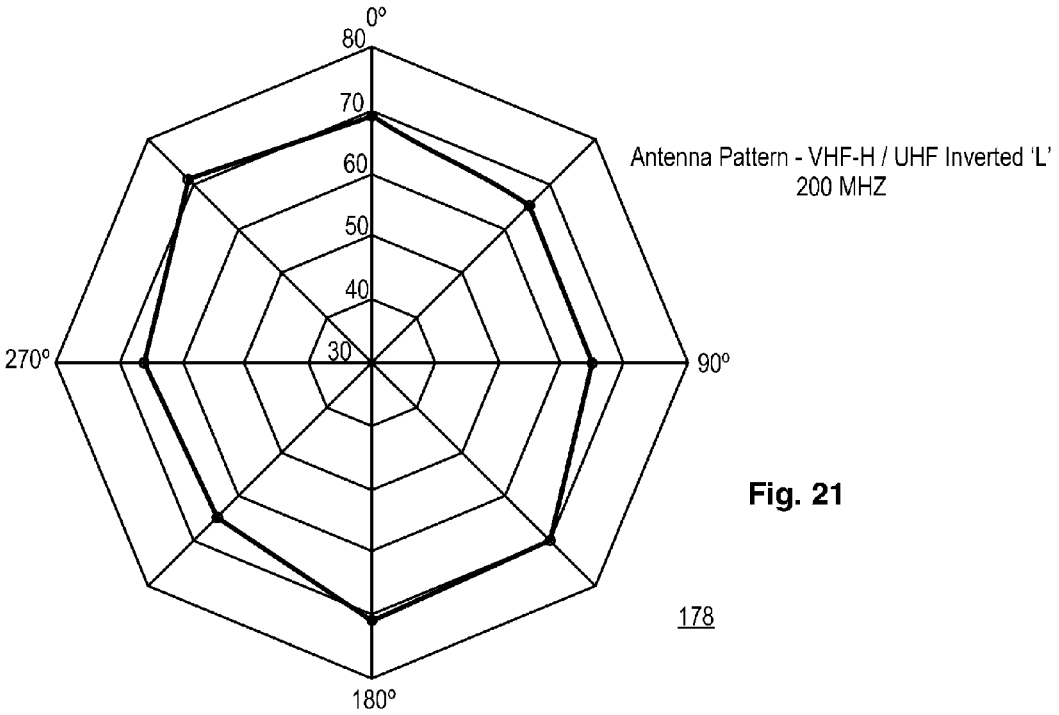
FIG. 21 is an antenna pattern diagram for a broadband modified inverted "L" antenna system according to an illustrative embodiment of the present invention.
Figure 22:
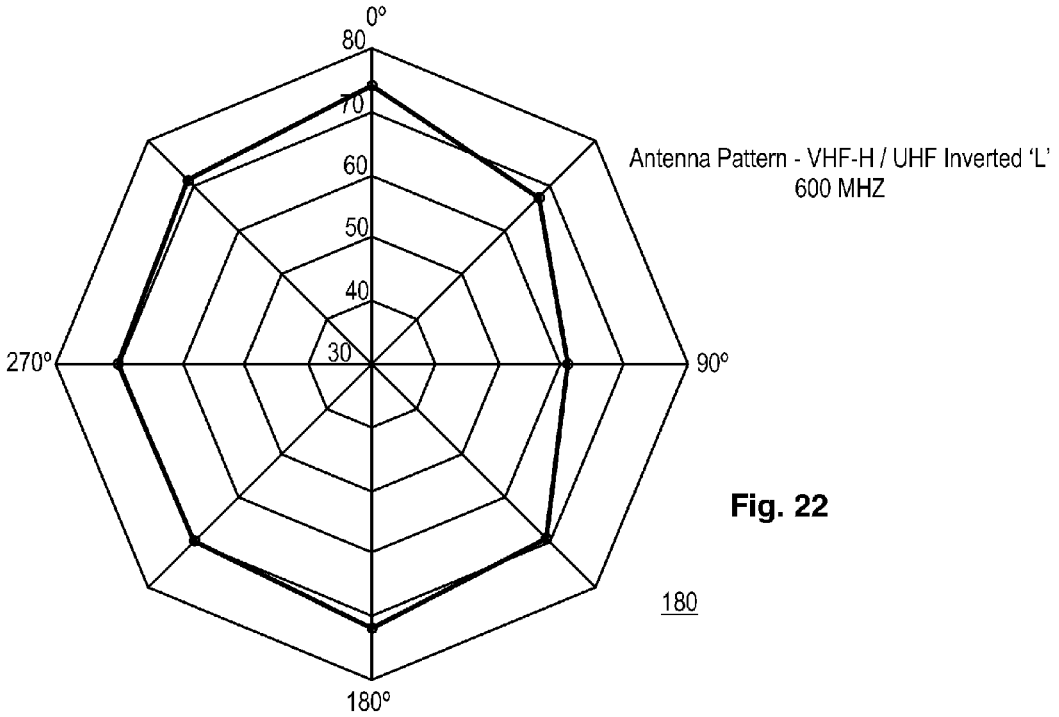
FIG. 22 is an antenna pattern diagram for a broadband modified inverted "L" antenna system according to an illustrative embodiment of the present invention.

Reference is direct to FIG. 21 and FIG. 22, which are antenna gain pattern diagrams at 200 MHz and 600 MHz, respectively, for the broadband inverted "L" antenna system of FIG. 17 according to an illustrative embodiment of the present invention. The gain patterns about the vertical axis of the antenna. Performance is consistent across the bands of interest, with good front to back balance along the main axis.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A broadband antenna apparatus, for reception of signals located about a center frequency within the UHF television frequency band, generally disposed along a plane, comprising:

a ground plate with an edge;

an inverted "L" antenna having a base leg and an elongated leg with a combined length selected to approximately equal one quarter wavelength of the center frequency of the UHF television band, defining an interior corner, which is filled with a triangulated portion arranged to broaden the bandwidth of said inverted "L" by at least fifty percent, and having a feed point at a distal end of said base leg, and wherein said antenna is oriented with said distal end of said base leg adjacent to said edge with a first dielectric gap therebetween, and oriented with said elongated leg parallel to said edge;

a first parasitic ground element extending from said edge and positioned adjacent to said base leg with a second dielectric gap therebetween, and selected to further increase the bandwidth of said inverted "L" antenna beyond said at least fifty percent;

a second parasitic ground element extending from said edge, and selected to further increase bandwidth about said center frequency to continuously cover all channel frequencies falling within the UHF television frequency band.

2. The apparatus of claim 1, and wherein:

said first parasitic ground element is configured to yield an input impedance to said feed point optimized to match a feed line impedance.

3. The apparatus of claim 1, and wherein:

said first parasitic ground element extends perpendicularly from said edge and in parallel with said base leg of said antenna element.

4. The apparatus of claim 1, and wherein:

said second parasitic ground element extends perpendicularly from said edge.

5. The apparatus of claim 1, and wherein:

said ground plate, said antenna element, said first parasitic ground element, and said second parasitic ground element are fabricated as conductive etchings on a printed circuit board substrate.

6. The apparatus of claim 1, and wherein said antenna base leg and elongated leg have a width that is between three and nine percent of their combined length.

7. The apparatus of claim 6, and wherein:

said first parasitic ground element has a width that is substantially the same as said width of said antenna elongated leg.

8. The apparatus of claim 1, and wherein:

said center frequency lies within the UHF television band between 470 MHz and 900 MHz.

9. A broadband antenna apparatus, for reception of signals located about a center frequency within the UHF television frequency band, generally disposed along a plane, comprising:

a ground plate having a linear edge, and disposed along the plane;

an antenna element disposed along the plane, and having a base leg at right angle to an elongated leg with a combined length selected to approximately equal one quarter wavelength of the center frequency of the UHF television band, thereby defining an exterior "L" shape and an interior corner, said interior corner filled with a triangulated portion through substantially the entire length of said base leg and through a portion greater than fifty percent of the length of said elongated leg, thereby broadening the bandwidth of said antenna element by at least fifty percent, said antenna element having a radio frequency feed point located adjacent to a distal end of said base leg, and wherein said ground plate and said antenna element are oriented with said distal end of said base leg positioned adjacent to said linear edge, with a first dielectric gap therebetween, and oriented with said elongated leg of said antenna element arranged substantially parallel to said edge;

a first parasitic ground element extending perpendicularly from said linear edge, adjacent to and substantially parallel with the exterior side of said base leg of said antenna element, thereby defining a second dielectric gap therebetween, said first parasitic ground element having a length extending from said linear edge to approximately the same distance from said edge as the exterior side of said elongated leg of said antenna element to further increase the bandwidth of said inverted "L" antenna beyond said at least fifty percent, and a second parasitic ground element extending perpendicularly from said linear edge on the opposite side of said first parasitic element from said antenna element, and adjacent to and substantially parallel with said first parasites ground element, thereby defining a third dielectric gap therebetween, said second parasitic ground element having a length shorter then said first parasitic ground element to further increase bandwidth about said center frequency to continuously cover all channel frequencies falling within the UHF television frequency band.

10. The apparatus of claim 9 and wherein;

said ground plate, said antenna element, said first parasitic ground element, and said second parasitic ground element are fabricated as conductive etchings on a printed circuit board substrate.

11. The apparatus of claim 9 and wherein;

said ground plate, said antenna element, said first parasitic ground element, and said second parasitic ground element are fabricated from metallic plate material.

12. The apparatus of claim 9, and wherein said ground plate has an elongated form with said edge defining a side having a length that is substantially longer than said elongated leg of said antenna element, and a width that is less than one-quarter of said length.

13. The apparatus of claim 9, and wherein said antenna element base leg and elongated leg have a width that is approximately seven percent of their combined length, and wherein said triangulated portion is formed exclusive of said width of said base leg and said elongated leg.

14. The apparatus of claim 13 and wherein said first parasitic ground element has a rectangular form having a width that is substantially equal said width of said antenna element base leg and elongated leg, and wherein said second parasitic ground element has a rectangular form having a width that is substantially equal said width of said antenna element base leg and elongated leg.

15. The apparatus of claim 9 and wherein said triangulated portion is bounded by a base side corresponding said base leg, and elongated side corresponding to said elongated leg, and a hypotenuse side, and wherein said hypotenuse side is defined by of two line segments intersecting at an obtuse external angle.

16. The apparatus of claim 9 wherein the broadband frequency range is 470 MHz to 900 MHz, and wherein said base leg of said antenna element has a length of 71 mm and a width of 14.5 mm, and wherein said elongated leg of said antenna element has a length of 141 mm and a width of 15 mm, and wherein said triangulated portion of said antenna element extends through 91 mm of the length of said elongated leg, measured from said outside corner, and wherein said first dielectric gap is 5 mm, and said second dielectric gap is 2.5 mm, and wherein said first parasitic ground element is 76 mm long and 14.5 mm wide, and wherein said third dielectric gap is 3 mm wide, and wherein said second parasitic ground element is 64 mm long and 14.5 mm wide.

17. The apparatus of claim 9 adapted for television reception in the UHF band of 470 MHz to 900 MHZ, and further adapted to additionally receive the television VHF band, and further comprising:

a radio frequency output connector electrical coupled to said radio frequency feed point through a coaxial cable;

a pair of telescopic rabbit-ear antenna coupled through a 1:1 balun and a low pass filter to said radio frequency output connector, and a housing adapted to support said antenna apparatus and said pair of telescopic rabbit ear antenna.

18. The apparatus of claim 17, and wherein said housing is configured to appear as a picture frame, and further comprising:

a means to engage a picture.

19. A broadband antenna apparatus, for reception of signals located about a center frequency within the UHF television frequency band, generally disposed along a plane, comprising:

a ground plate having a linear edge, and disposed along the plane;

an antenna element disposed along the plane, and having a base leg at right angle to an elongated leg with a combined length selected to approximately equal one quarter wavelength of the center frequency of the UHF television band, thereby defining an exterior "L" shape and an interior corner, said interior corner filled with a triangulated portion through substantially the entire length of said base leg and through a portion greater than fifty percent of the length of said elongated leg, thereby broadening the bandwidth of said antenna element by at least fifty percent, said antenna element having a radio frequency feed point located adjacent to a distal end of said base leg, and wherein said elongated ground plate and said antenna element are oriented with said distal end of said base leg positioned adjacent to said linear edge with a dielectric gap therebetween, and oriented with said elongated leg of said antenna element arranged substantially parallel to said edge;

a first parasitic ground element having a first portion extending from said linear edge, adjacent to and in parallel with the exterior side of said base leg of said antenna element, and having a length extending beyond the exterior side of said elongated leg of said antenna element, and said first parasitic ground element having a second portion extending at right angle from said first portion adjacent to and in parallel with the exterior side of said elongated leg of said antenna element to further increase the bandwidth of said inverted "L" antenna beyond said at least fifty percent;

a second parasitic ground element having a first portion connected at right angle to a second portion, thereby defining an interior corner and an exterior corner, said first portion extending perpendicularly from said linear edge on the opposite side of said antenna element from said first parasitic element, and said second portion extending adjacent to and in parallel with the exterior side of said elongated leg of said antenna element to further increase bandwidth about said center frequency to continuously cover all channel frequencies falling within the UHF television frequency band.

20. The apparatus of claim 19 and wherein;

said ground plate, said antenna element, said first parasitic ground element, and said second parasitic ground element are fabricated as conductive etchings on a printed circuit board substrate.

21. The apparatus of claim 19, and wherein a distal end of said elongated leg of said antenna element has a 180 degree radius end, and said corner of said antenna element is rounded with the same radius.

22. The apparatus of claim 19, and wherein said antenna element elongated leg has a width that is approximately 4.3 percent of the combined length of said base lend and said elongated leg.

23. The apparatus of claim 22, and wherein said first portion and said second portion of said first parasitic ground element have the same width as said elongated leg of said antenna element, and wherein said first portion and said second portion of said second parasitic ground element have the same width as said elongated leg of said antenna element, and wherein said ground plate has an elongated form with said edge defining a side having a length that is substantially longer than said elongated leg of said antenna element plus said width of said first portion of said first parasitic ground element plus said width of said first portion of said second parasitic ground element, and wherein said elongated ground plate has a width that is less than one-tenth of said length.

24. The apparatus of claim 22, and wherein said first parasitic ground element and said second parasitic ground element each have a width that is substantially the same as said elongated leg of said antenna element, and wherein a distal end of said first parasitic ground element has a 180 degree radius end, and wherein a distal end of second first parasitic ground element has a 180 degree radius end, and wherein the exterior corner between said first portion and said second portion of said first parasitic ground element and said second parasitic ground element are rounded with the same radius.

25. The apparatus of claim 19, and wherein said first portion and said second portion of said second parasitic ground element at right angle form an interior corner, and further comprising:

a triangulated parasitic ground portion disposed upon said interior corner for a substantial portion of the length of said first portion and said second portion of said second parasitic ground element, thereby further broadening the bandwidth of said broadband antenna apparatus.

26. The apparatus of claim 19, and wherein the broadband frequency range is 174 MHz to 900 MHz, and wherein said base leg of said antenna element has a length of 70 mm and a width of 10 mm, and wherein said elongated leg of said antenna element has a length of 254 mm and a width of 14 mm, and wherein said triangulated portion of said antenna element extends through 139 mm of the length of said elongated leg, measured from said outside corner, and wherein said first dielectric gap is 4 mm, and wherein said first portion and said second portion of said first parasitic ground element are 14 mm wide, said first portion is 70 mm long and said second portion is 90 mm long, and wherein said first portion and said second portion of said second parasitic ground element are 14 mm wide, said first portion is 160 mm long and said second portion is 104 mm long, and wherein said ground plate is 324 mm long and 30 mm wide, and said linear edge of said ground plate is 296 mm long.

27. The apparatus of claim 19, and wherein the broadband frequency range is 174 MHz to 700 MHz, further comprising:

a broadband radio frequency amplifier having a usable gain range between 174 MHz and 700 MHz coupled to receive radio signals from said radio frequency feed point, and having a radio frequency output for coupling to a radio signal feed line.

28. The apparatus of claim 27, further comprising:

a power supply circuit coupled to provide regulated power to a radio signal feed line coupled to said radio frequency output, and wherein said broadband radio frequency amplifier is coupled to receive regulated power from said radio frequency output.

* * * * *